US006857169B2

(12) United States Patent
Chung

(10) Patent No.: US 6,857,169 B2
(45) Date of Patent: Feb. 22, 2005

(54) STRUCTURE OF MAGNETIC BUCKLE

(75) Inventor: Yao-Tsu Chung, Taoyuan Hsien (TW)

(73) Assignee: Taiwan Industrial Fastener Corporation, Taipei (TW)

( * ) Notice: Subject to any disclaimer, the term of this patent is extended or adjusted under 35 U.S.C. 154(b) by 0 days.

(21) Appl. No.: 10/315,090

(22) Filed: Dec. 10, 2002

(65) Prior Publication Data

US 2004/0107547 A1 Jun. 10, 2004

(51) Int. Cl.[7] ..... A44B 11/25
(52) U.S. Cl. ..... 24/303
(58) Field of Search ..... 24/303; 292/251.5; 335/285

(56) References Cited

U.S. PATENT DOCUMENTS 3,293,714 A * 12/1966 Shafer ..... 24/303
3,589,341 A * 6/1971 Krebs ..... 24/303
5,664,298 A * 9/1997 Nessar-Ivanovic ..... 24/303
6,292,985 B1 * 9/2001 Grunberger ..... 24/303
6,505,385 B2 * 1/2003 Grunberger ..... 24/303

* cited by examiner

*Primary Examiner*—Robert J. Sandy
(74) *Attorney, Agent, or Firm*—Bacon & Thomas, PLLC

(57) ABSTRACT

A magnetic buckle. The magnetic buckle includes a male buckle having a magnetic element, and a female buckle having a magnetic element. The magnetic elements of the male and female buckles facilitate the alignment of the male buckle with the female buckle when they are positioned horizontally opposite to each other, as well as the steady insertion of the male buckle into the fit-in groove of the female buckle under the influence of the magnetic attraction. The male buckle can be prevented from slipping off vertically from the female buckle even under an external force, and this arrangement further provides a stronger resistance to the buckled state against any horizontal pulling force.

5 Claims, 6 Drawing Sheets

STRUCTURE OF MAGNETIC BUCKLE

BACKGROUND OF THE INVENTION

1. Field of the Invention

The present invention relates to a structure of magnetic buckle, more particularly relates to a structure of magnetic buckle comprising a male and a female buckle, wherein the male buckle is aligned with the female buckle when the male buckle is positioned opposite to the female buckle by a magnetic attraction and the male buckle can be promptly inserted into the space of the female buckle under the influence of the magnetic attraction.

2. Description of the Related Art

A conventional way of securing two ends of a belt together is accomplished by using a buckle. Typically a buckle of a belt comprises a male buckle and a female buckle for securing, for example, a bag, a shoe or a suitcase and the like. Referring to FIGS. 7 and 8 shows a structure of conventional buckle B comprising a male buckle B1 having a resilient arm B11 laterally positioned on each side, and an alignment arm B12 is positioned in between the two resilient arms B11. The female buckle B2 comprises an opening B21 having a track B211 disposed in an inner portion for guiding the resilient arms B11 and the alignment arm B12 of the male buckle B1 for positioning the male buckle B1 into the opening B21 of the female buckle B2 when the male buckle B1 is pushed into the female buckle B2. After the male buckle B1 is engaged into the female buckle B2, buckling blocks B13 formed at the distal end of the resilient arms B11 fit into the side openings B22 that are positioned on two sides of the female buckle B2. Further, a portion of the buckling block B13 that protrudes from the resilient arm B11 forms as a corner B14, which is for positioning the buckling block B13 to the side wall B221 of the side opening B22. The above-mentioned conventional buckle is substantially effective for buckling engagement, nevertheless, there are several drawbacks as described below:

1. The structure of the conventional buckle is not suitable for applying in smaller articles such as, for example, shoes, watches, belts, and alike. Typically, a user uses fingers to press the buckling blocks B13 of the male buckle B1 that are fitted inside the side openings B22 that are disposed on the two sides of the female buckle B2 in order to release the male buckle B1 from the female buckle B2. However, if the size of the conventional buckle B is made smaller, then space available around the buckle B for the user to use fingers for pressing the buckling blocks B13 of the male buckle B1 will also corresponding smaller, thus it would be very difficult for a user to use the fingers to press the buckling blocks B13 when the size of the male buckle B1 and female buckle B2 is made smaller for applying them in smaller articles such as shoes, watches, belts, and the like.

2. The design of the resilient arms B11 and the alignment arm B12 of the male buckle B1 of the conventional buckle B are extendedly protruded without any support, thus the male buckle B1 would easily hook other near articles while in unbuckled state. Besides, the resilient arms B11 and the alignment arm B12 of the male buckle B1 will get easily deformed or even broken due to excessive external force.

3. The design of the conventional buckle B structure is more complicated, a precise tolerance between the male buckle B1 and female buckle B2 for handling is required, thus it is more difficult to produce such conventional buckle B, and accordingly, the chances of producing flaw items is higher.

4. While pushing the male buckle B1 into the female buckle B2, there is higher possibility of misalignment if the user does not accurately fit the resilient arms B11 and the alignment arm B12 of the male buckle B1 into the openings B21 of the female B2. Thus this would cause difficulty and inconvenient for the user to repeat the action of buckling.

SUMMARY OF THE INVENTION

Accordingly, in the view of the foregoing, the present inventor makes a detailed study of related art to evaluate and consider, and uses years of accumulated experience in this field, and through several experiments, to create a structure of magnetic buckle of the present invention. The present invention provides an innovated cost effective structure of a magnetic buckle which is capable applying in smaller articles such as shoes, belts, watches, and the like.

Accordingly, it is an object of the inventor of present invention to provide a brand-new structure of a magnetic buckle that can be positioned promptly and prevented from being slipping off vertically and the same time having a resistance against horizontal pulling external force.

In accordance with the above objects and other advantages of the present invention as broadly embodied and described herein, the present invention provides a structure of buckle comprising a male buckle having a magnetic element, a female buckle having a magnetic element, wherein the magnetic elements of the male and female buckles facilitates the alignment of the male buckle with the female buckle when they are positioned horizontally opposite to each other, as well as facilitates steady insertion of the male buckle into the fit-in groove of the female buckle under the influence of the magnetic attraction.

According to an aspect of the present invention, the buckling element of the male buckle comprises a buckling block, in the fit-in groove of the female buckle comprises a buckling groove for fitting the buckling block of the male buckle, when the buckling element of the male buckle enters the fit-in groove of the female buckle, the male buckle is prevented from slipping off vertically from the female buckle by the external force and this further provide a stronger resistance to the buckled state against any horizontal pulling force.

BRIEF DESCRIPTION OF THE DRAWINGS

For a more complete understanding of the present invention, reference will now be made to the following detailed description of preferred embodiments taken in conjunction with the accompanying drawings, in which.

DESCRIPTION OF THE PREFERRED EMBODIMENTS

Figure 1:
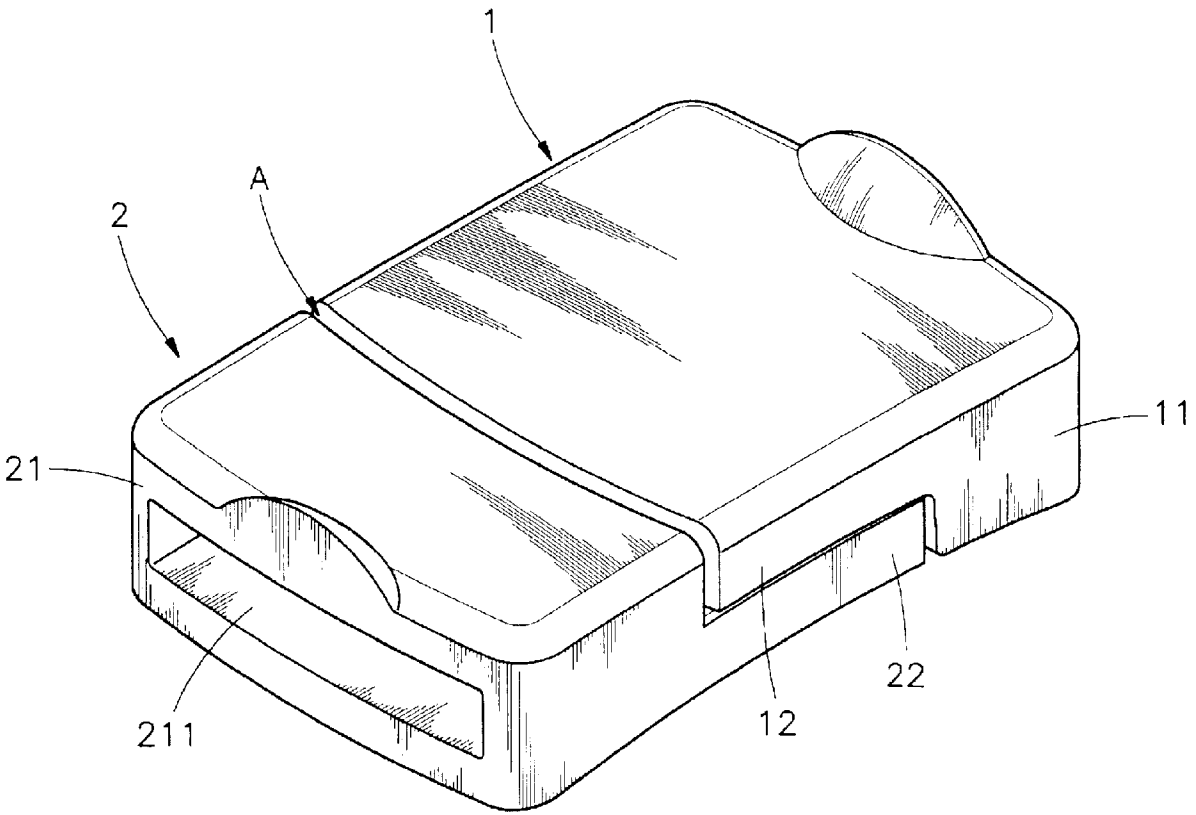
FIG. 1 is an elevational view of a structure of the magnetic buckle of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
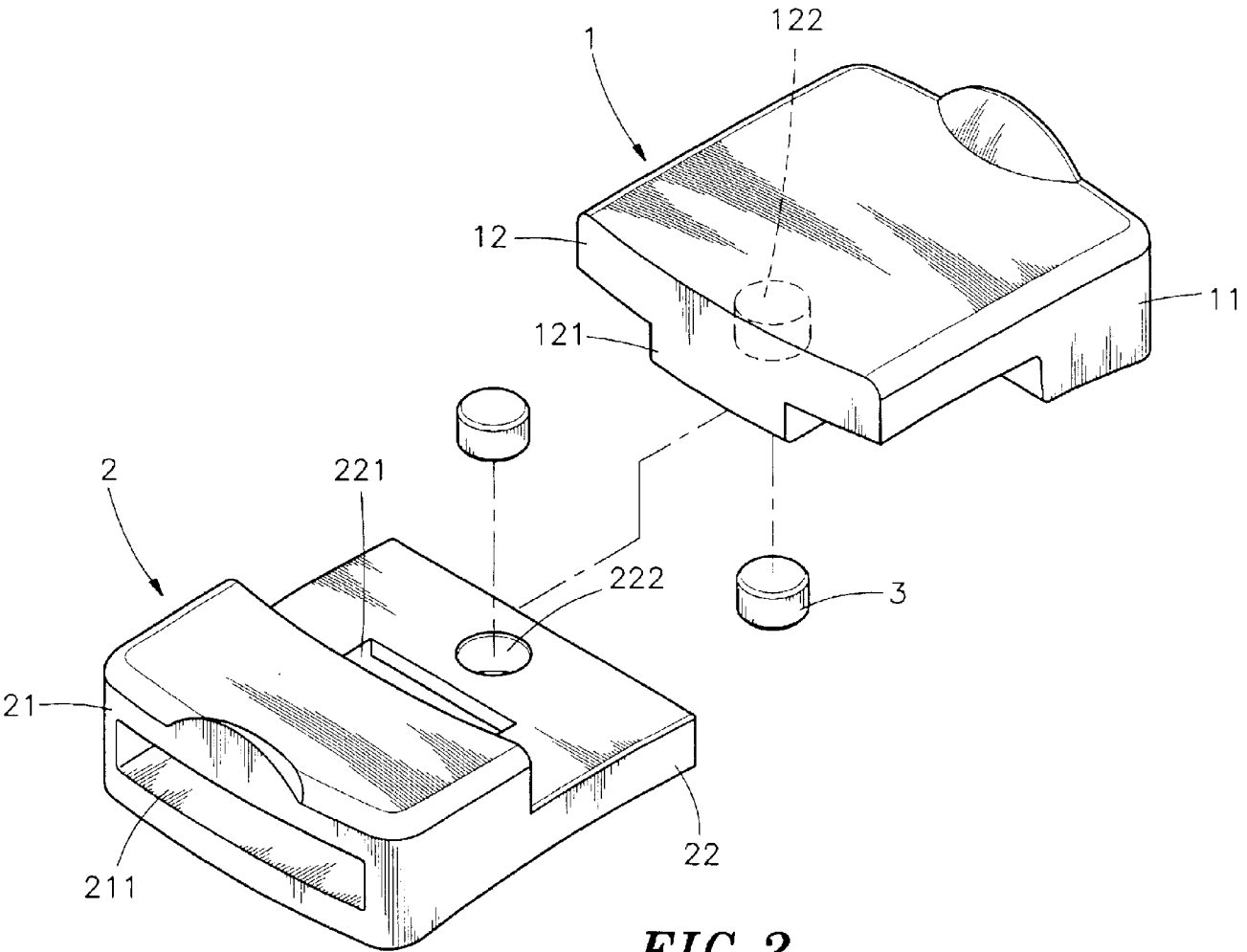
FIG. 2 is an exploded view of the structure of the magnetic buckle of the present invention.
Figure 3:
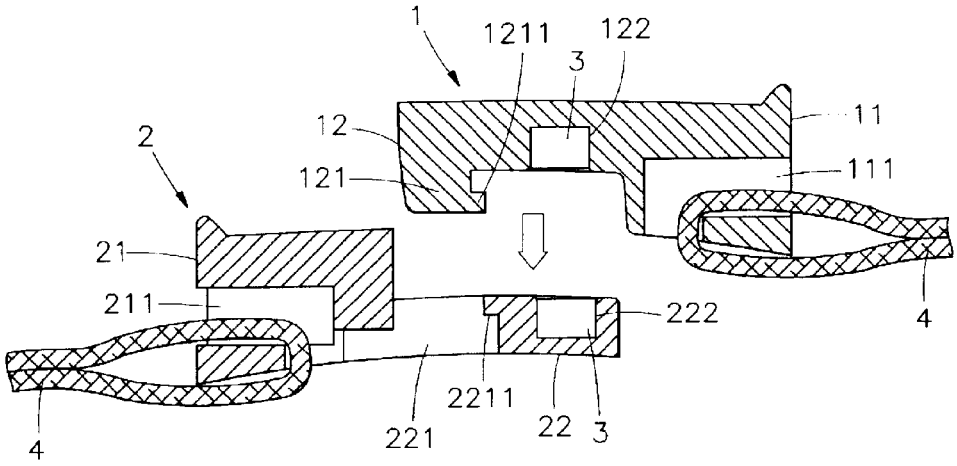
FIG. 3 is a sectional side view showing before the male buckle is buckled into the female buckle according to a preferred embodiment of the present invention.

Referring to FIGS. 1, 2 and 3, the magnetic buckle of the present invention comprises a male buckle 1 and a female buckle 2.

The male buckle 1 comprises a base portion 11, a buckling portion 12 is disposed on a flange of the base portion 11, wherein the buckling portion 12 comprises a buckling element 121 at a base part thereof, and a groove 122 at a rear portion of the buckling element 121 for inlaying a magnetic element 3. A protruded buckling block 1211 is disposed on an inner side of the buckling element 121. A through channel 111 is disposed one side of the base portion 11 of the male buckle 1 for fitting and positioning a knitted belt 4.

The female buckle 2 comprises a base portion 21, a buckling portion 22 is disposed at a bottom flange of a side of the base portion 21, wherein the buckling portion 22 comprises a fit-in groove 221 having a buckling groove 2211 formed within. A groove 222 is disposed at a frontal side of the female buckle 2 for fitting the magnetic element 3, and a through channel 211 is disposed on one side of the base portion 21 of the female buckle 2 for positioning the knitted belt 4.

Referring to FIGS. 3, 4, 5 and 6, shows various sectional side views of the buckle of the present invention. As shown in the figures, while assembling, it is preferred that the buckling portion 12 of the male buckle 1 face the buckling portion 22 of the female buckle 2 and then pressed downwardly in order to fit the buckling element 121 of the male buckle 1 into the fit-in groove 221 of the female buckle 2. Meanwhile, the magnetic elements 3 of the male and female buckles 1 and 2 will attract each other, and after fitting the buckling element 121 of the male buckle 1 into the fit-in groove 221 of the female buckle 2, the attraction of the magnetic elements 3 of the male and female buckles 1 and 2 will make male buckle 1 and female buckle 2 move horizontally towards each other, then the protruded buckling block 1211 that are formed on the inner side of the buckling element 121 of the male buckle 1 will directly fit into the buckling groove 2211 of the fit-in groove 221 of the female buckle 2.

Furthermore, a reserved space A will be formed between the base portions 11, 21 and the buckling portions 12, 22 of the above male buckle 1 and female buckle 2 in the buckled state, when the user wishes to release the male buckle 1 from the female buckle 2, the user can press the male buckle 1 and the female buckle 2 inwardly together with the reserved space A, in doing so, the buckling block 1211 of the male buckle 1 will slip off from the buckling groove 2211 of the female buckle 2, in the mean time magnetic elements 3 of the male and female buckles 1 and 2 are alternately positioned allowing the male buckle 1 move upwardly, then the buckling element 121 of the male buckle 1 can be slipped out of the fit-in groove 221 of the female buckle 2. Thus, the male buckle 1 can be released from the female buckle 2.

Therefore, the structure of the buckle of the present invention can be applied in bags, shoes, watches, belts and for those articles which needs buckling. The features of the present invention are as follows:

1. The buckle of the present invention uses the fit-in groove 221 of the female 2 to fit the buckling element 121 of the male buckle 1, and the magnetic attraction of two magnetic elements 3 to make the male and female buckles 1 and 2 move horizontally towards each other, and steadily fit the buckling element 121 of the male buckle 1 into the fit-in groove 221 of the female buckle 2. When buckling the male and female buckles 1 and 2, it can be positioned promptly and prevented from slipping off vertically, and this further provides a stronger resistance to the buckled state against any horizontal pulling force.

2. Since the buckling element 121 of the male buckle 1 comprises a buckling block 1211, the fit-in groove 221 of the female buckle 2 comprises a buckling groove 2211 for fitting the buckling block 1211 of the male buckle 1, and therefore as the buckling element 121 of the male buckle 1 enter the fit-in groove 221 of the female buckle 2, the buckling block 1211 can be securely fitted into the buckling groove 2211 of the female buckle 2 thus the male buckle 1 can be prevented from slipping off vertically from the female buckle 2 even under an external force, and this further provides a stronger resistance to the buckled state against any horizontal pulling force.

Figure 4:
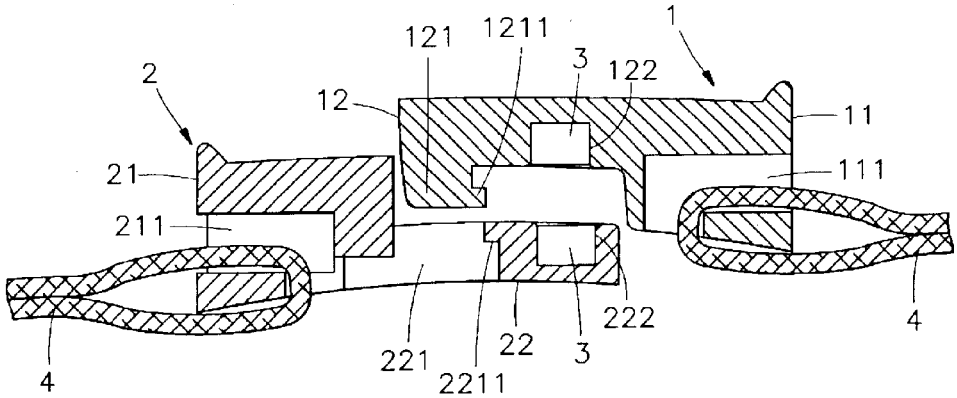
FIG. 4 is the sectional side view showing while the male buckle buckles into the female buckle according to a preferred embodiment of the present invention (I).
Figure 5:
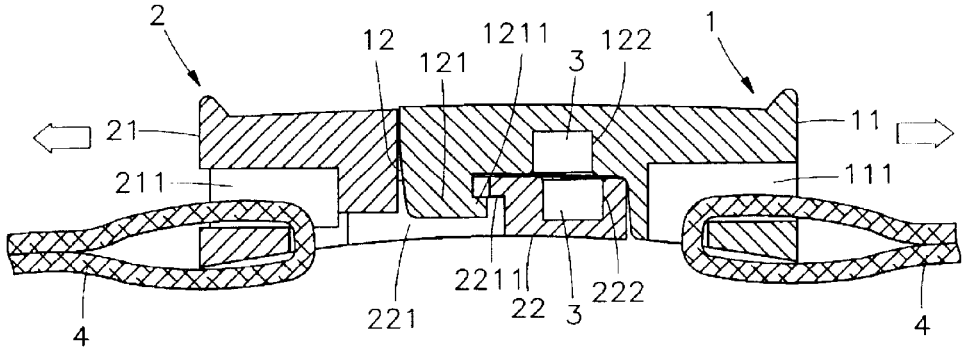
FIG. 5 is the sectional side view showing while the male buckle buckles into the female buckle according to a preferred embodiment of the present invention (II)
Figure 6:
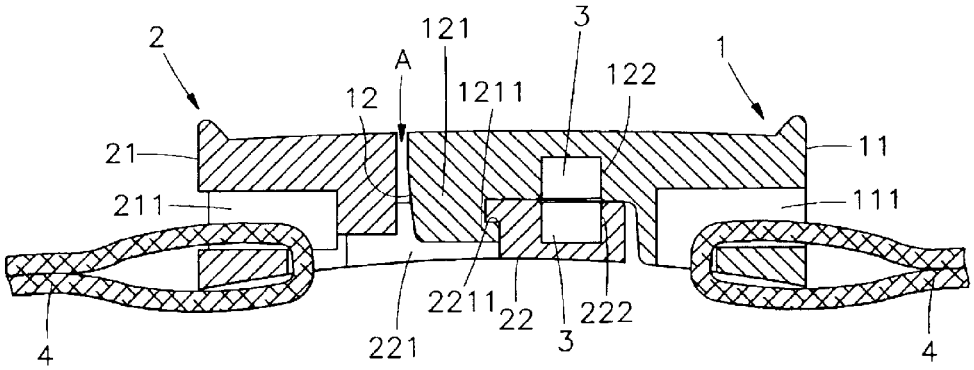
FIG. 6 is the sectional side view showing after the male buckle is buckled into the female buckle according to a preferred embodiment of the present invention.
Figure 7:
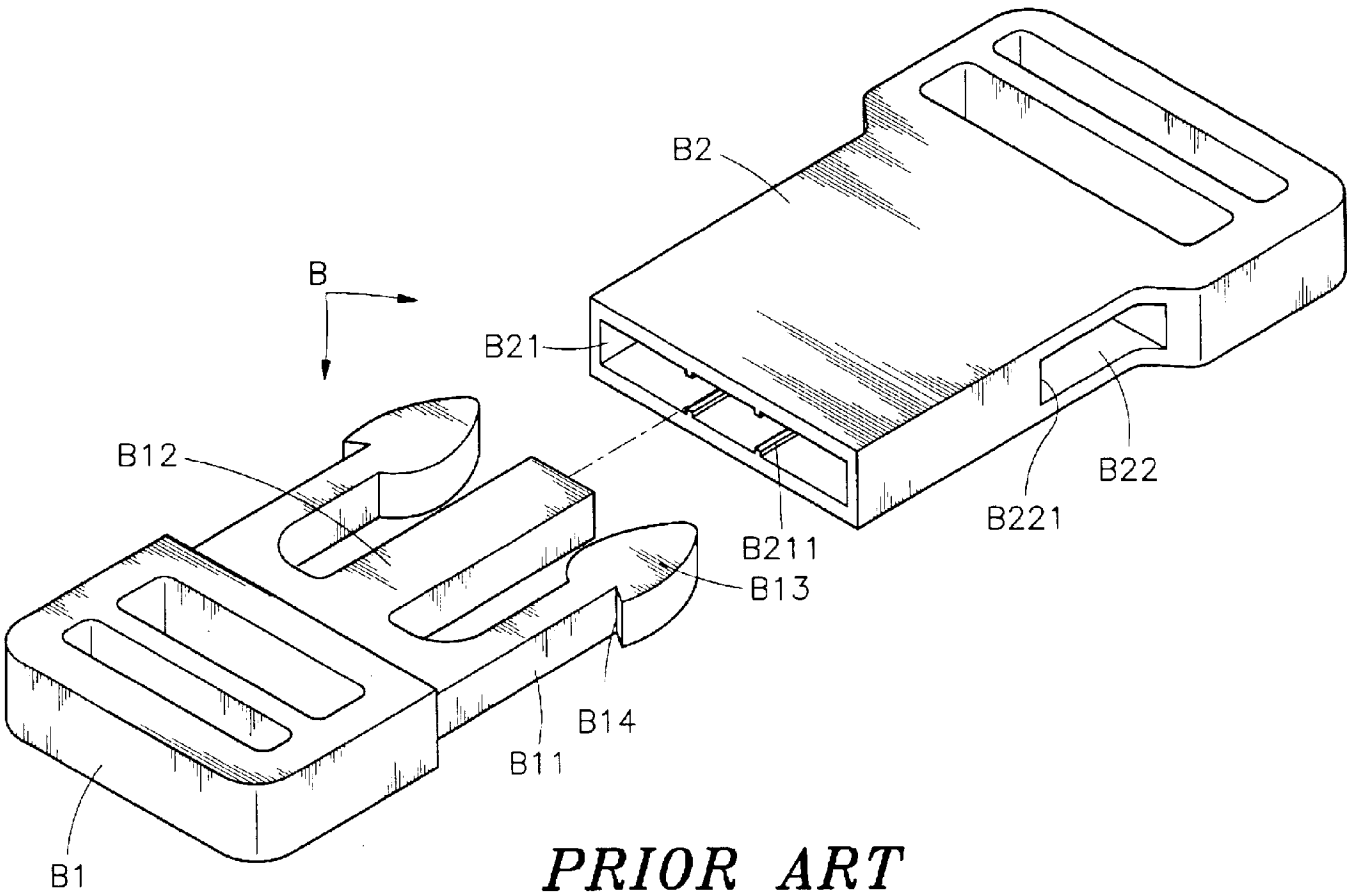
PRIOR ART FIG. 7
FIG. 7 is an exploded view of the structure of a conventional buckle.
Figure 8:
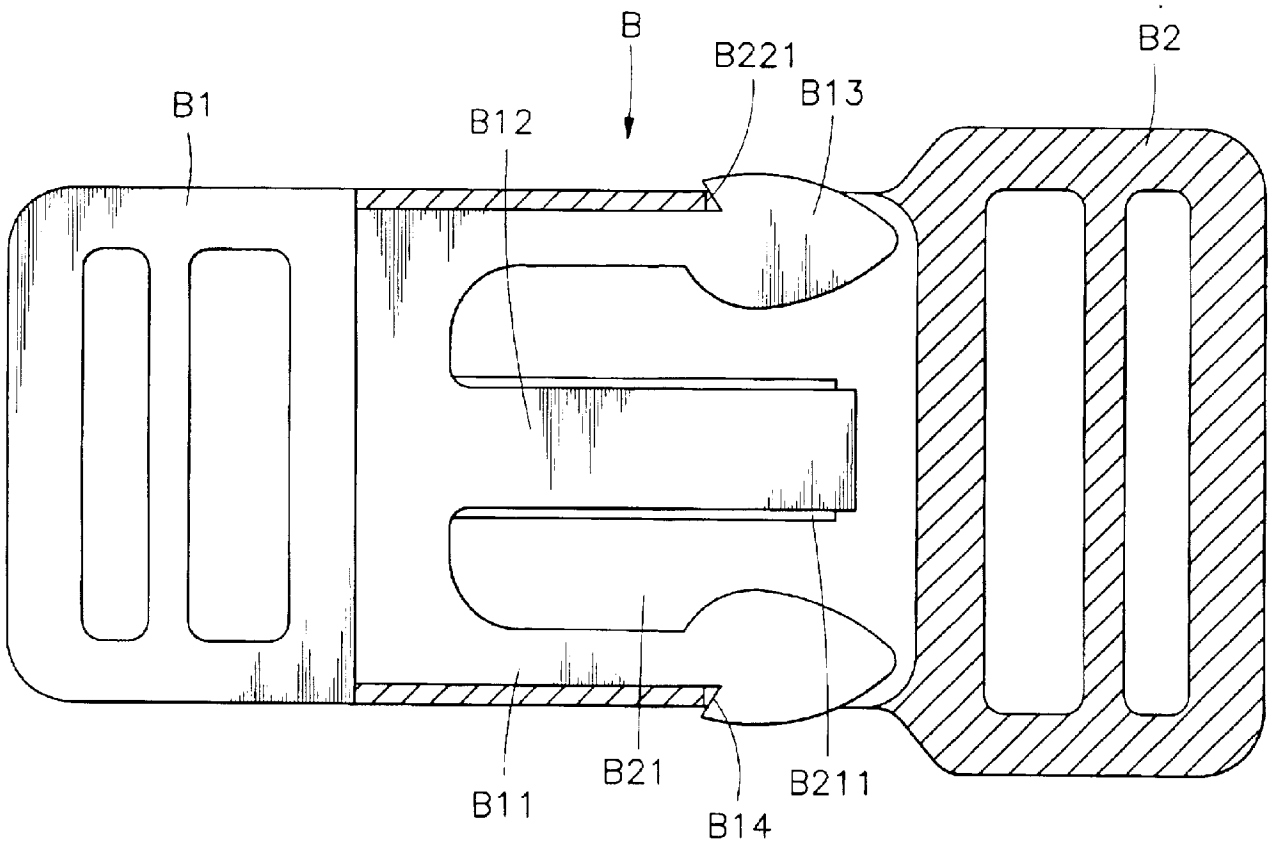
PRIOR ART FIG.8
FIG. 8 is a sectional side view showing after the male buckle is buckled into the female buckle according to an embodiment of the conventional art.

As shown in FIGS. 3–5, the attraction of the magnetic elements 3 of the male and female buckles 1, 2 will move the male buckle 1 and the female buckle 2 in a direction transverse to the longitudinal length of the magnetic buckle towards each other to position the buckling block of the first buckling element 121 of the male buckle steadily into the indented buckling groove of the fit-in groove 221 of the female buckles, and the magnetic buckle resists external forces that are perpendicular to each other.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations, which fall within the spirit and scope of the included claims. All matters set forth herein or shown in the accompanying drawings are to be interpreteded in an illustrative and non-limiting sense.

What is claimed is:

1. A structure of magnetic buckle, comprising:

a male buckle comprising a first base portion, a first buckling portion formed at a side flange of said first base portion, the first buckling portion comprises a first buckling element and a first magnetic element, said first buckling element of said male buckle comprises a buckling block;

a female buckle comprising a second base portion, a second buckling portion and a fit-in groove disposed between the second base portion and the second buckling portion for fitting and positioning said buckling element of said male buckle, said fit-in groove of said female buckle comprises an indented buckling groove, a second magnetic element positioned in the second buckling portion for attracting the first magnetic element of said male buckle, wherein an attraction of the magnetic elements of said male and female buckles will move said male buckle and said female buckle in a direction transverse to the longitudinal length of the magnetic buckle towards each other, to position said buckling block of said first buckling element of said male buckle steadily into said indented buckling groove of said fit-in groove of said female buckle; and wherein a reserved space is formed between the first base portion of said male buckle and the second base portion of said female buckle when said male buckle and said female buckle are in a buckled state, and the magnetic buckle resists external forces that are perpendicular to each other.

2. The structure according to claim 1, wherein said base portion of said male buckle comprises a through channel for fitting a knitted belt.

3. The structure according to claim 1, wherein said base portion of said female buckle comprises a through channel for fitting a knitted belt.

4. The structure according to claim 1, wherein at a rear portion of the first buckling portion of said male buckle comprises a groove for inlaying a magnetic element.

5. The structure according to claim 1, wherein on a frontal surface of the second buckling portion of said female buckle comprises a groove for inlaying a magnetic element.

* * * * *